US005909534A

United States Patent [19]

Ko

[11] Patent Number: 5,909,534

[45] Date of Patent: Jun. 1, 1999

[54] VENTILATOR WITH FAR INFRARED GENERATORS

[76] Inventor: Li-Sheng Ko, 3/F, No. 245, Jao-Ho St., Taipei City, Taiwan

[21] Appl. No.: 09/022,210

[22] Filed: Feb. 12, 1998

[51] Int. Cl.[6] ..... F24C 1/14; F24F 7/00

[52] U.S. Cl. ..... 392/376; 392/370; 392/364; 219/553; 219/220; 454/293; 454/294; 454/354

[58] Field of Search ..... 392/375, 376, 392/363, 364, 370, 371; 219/220, 553; 454/293, 294, 354

[56] References Cited

U.S. PATENT DOCUMENTS

| | | | |
|---|---|---|---|
| 2,875,316 | 2/1959 | Ford et al. | 392/363 |
| 3,028,475 | 4/1962 | Nash | 392/364 |
| 3,215,828 | 11/1965 | Bonvallet et al. | 392/364 |
| 3,320,406 | 5/1967 | Wainwright | 392/364 |
| 3,785,271 | 1/1974 | Joy | 392/364 |
| 4,151,811 | 5/1979 | Truhan | 392/364 |
| 5,621,846 | 4/1997 | Smith et al. | 392/376 |
| 5,761,377 | 6/1998 | Wolfe et al. | 392/376 |

FOREIGN PATENT DOCUMENTS

| | | | |
|---|---|---|---|
| 516976 | 9/1955 | Canada | 392/364 |
| 633176 | 12/1961 | Canada | 392/364 |
| 54-13029 | 1/1979 | Japan | 219/553 |
| 2-140520 | 5/1990 | Japan | 392/373 |
| 427822 | 5/1953 | United Kingdom | 392/364 |

*Primary Examiner*—Teresa J. Walberg
*Assistant Examiner*—Vinod D. Patel
*Attorney, Agent, or Firm*—Rosenberg, Klein & Bilker

[57] ABSTRACT

A ventilation device having a housing with a grille at the bottom and two ventilation members at two sides of the grille is provided. A fan assembly is mounted on the housing and controlled to draw filthy air out of a room through air vents in the ventilation members. The ventilation device includes a plurality of electronic heating tubes mounted inside the housing and controlled to produce heat. A plurality of sleeves formed of a far infrared emitting material are respectively mounted on the electric heating tubes and heated by the electric heating tubes to emit energy in the far infrared portion of the spectrum. A reflector is provided which reflects far infrared rays into the room through gaps in the grille, and a light source provided for illumination.

1 Claim, 4 Drawing Sheets

VENTILATOR WITH FAR INFRARED GENERATORS

BACKGROUND OF THE INVENTION

The present invention relates to ventilators, and more particularly to such a ventilator which emits far infrared rays into the room when operated to draw filthy air out of the room.

An electric heater may be used in a room during a cold day, so as to keep the room warm. In order to keep outside cold air from passing to the inside of the room, the door of the room may be closed, and the air inside the room becomes filthy quickly when hot.

SUMMARY OF THE INVENTION

It is one object of the present invention to provide a ventilation device which is compact, and needs less installation space. It is another object of the present invention to provide a ventilation device which emits far infrared rays when operated to draw filthy air out of the room. It is still another object of the present invention to provide a ventilation device which keeps the room warm when operated to draw filthy air out of the room. It is still another object of the present invention to provide a ventilation device which has a light source for illumination. To achieve these and other objects of the present invention, there is provided a ventilation device which comprises a housing having a grille at the bottom and two ventilation members at two sides of the grille, fan means mounted on the housing and controlled to draw filthy air out of the room through air vents on the ventilation members, a plurality of electric heating tubes mounted inside the housing and controlled to produce heat, a plurality of far infrared emitting sleeves respectively mounted on the electric heating tubes and heated by the electric heating tubes to emit far infrared rays, and reflector means which reflects far infrared rays into the room through gaps in the grille, and light source means mounted outside the housing for illumination.

DETAILED DESCRIPTION OF THE PREFERRED EMBODIMENT

Figure 1:
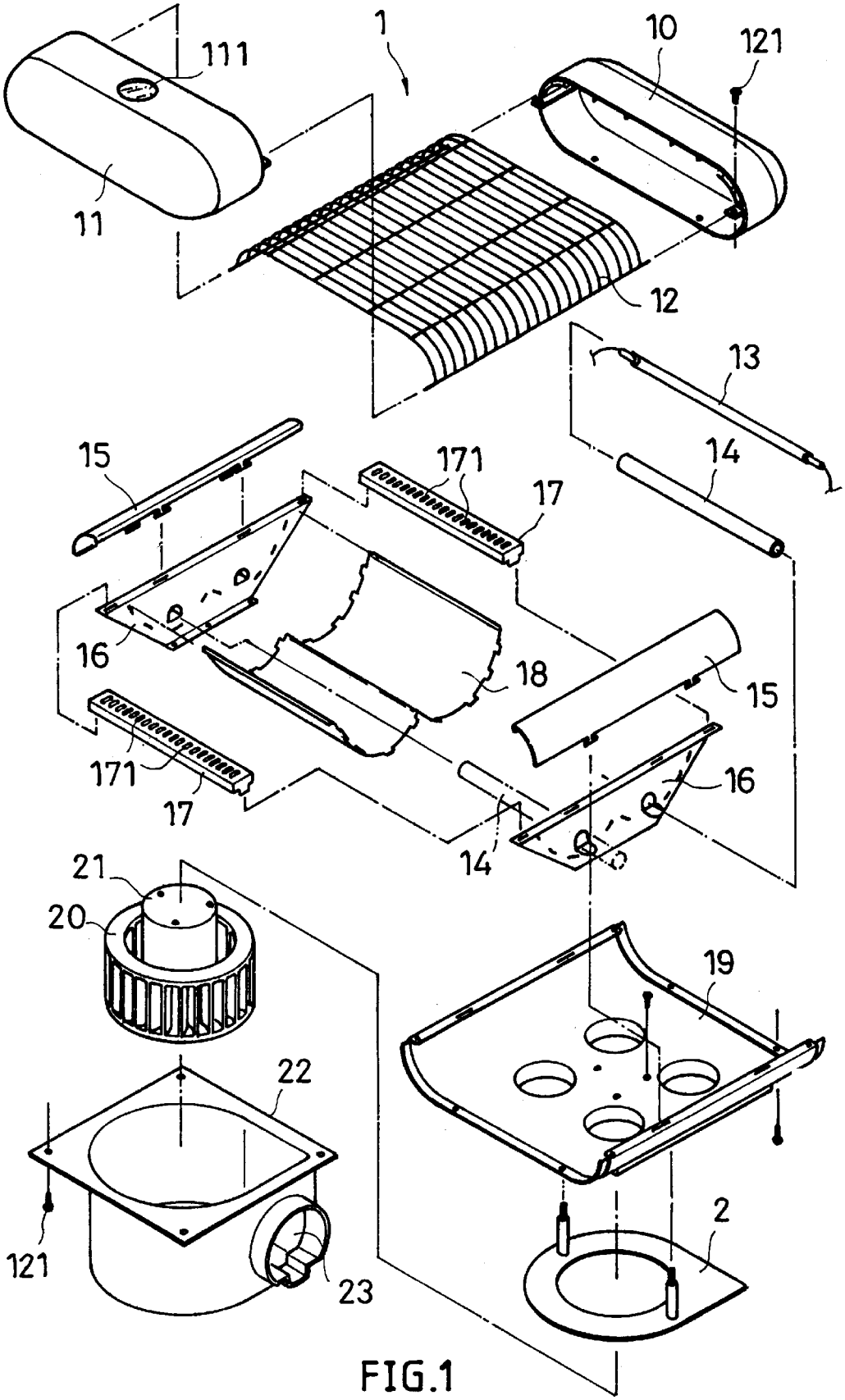
FIG. 1 is an exploded view of a ventilation device according to the present invention.
Figure 2:
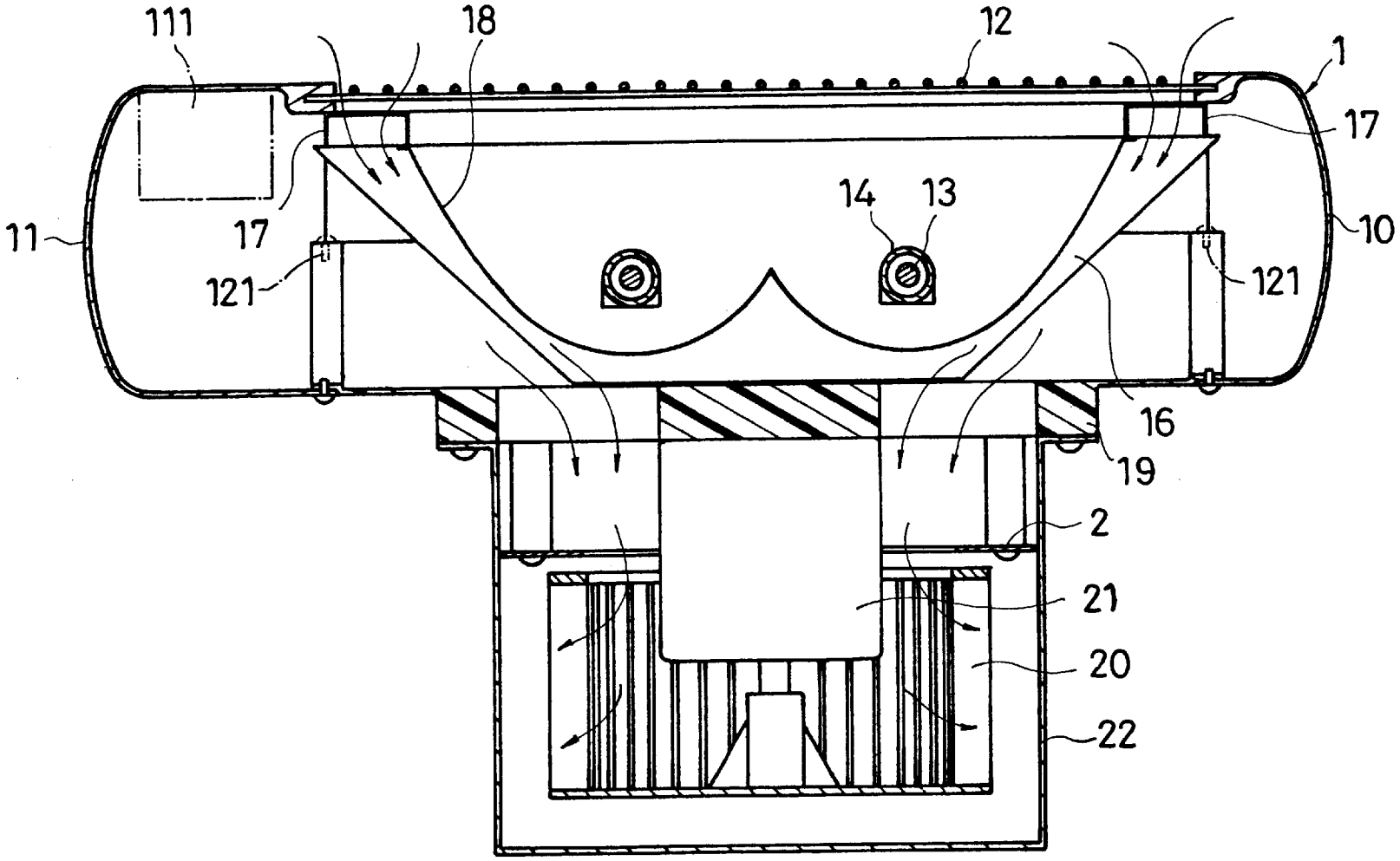
FIG. 2 is a longitudinal sectional view of the present invention, showing air being circulated.
Figure 3:
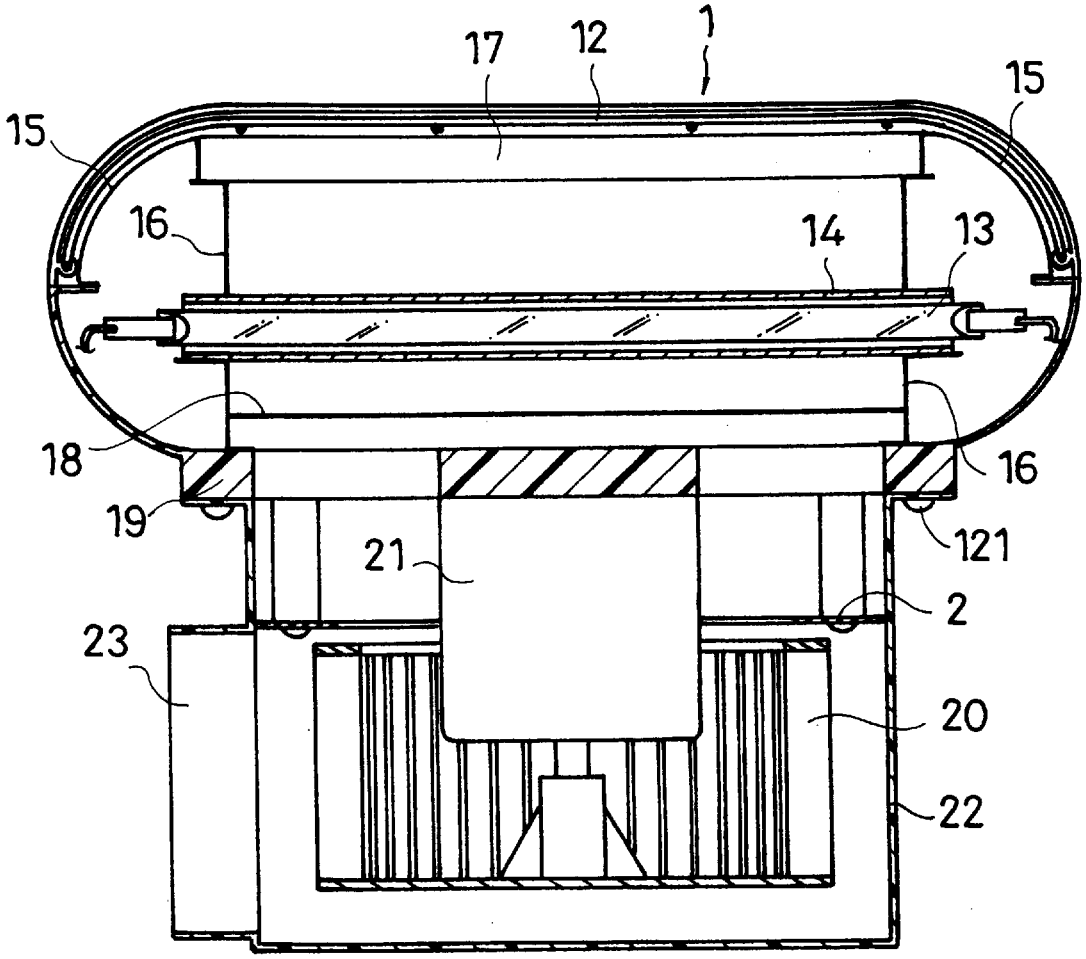
FIG. 3 is a transverse sectional view of the present invention, showing air being circulated; and, FIG. 4 is a perspective view of the present invention showing the ventilation device installed to a building structure.

Referring to FIGS. 1, 2 and 3, a ventilation device in accordance with the present invention comprises a housing 1, a hood 22 mounted on the housing 1 at the top, a fan motor 21 mounted inside the hood 22, and a fan 20 mounted inside the hood 22 and rotated by the fan motor 21.

The housing 1 is comprised of a right cover shell 10, a left cover shell 11, a grill 12 connected between the right cover shell 10 and the left cover shell 11 at the bottom and fixedly secured in place by screws 121, and a slotted top cover shell 19 connected between the right cover shell 10 and the left cover shell 11 at the top. Two supporting plates 16 are connected between the right cover shell 10 and the left cover shell 11 at two opposite sides of the grille 12. Two arched guard plates 15 are respectively connected between the right cover shell 10 and the left cover shell 11 and covered over the supporting plates 16 at the bottom. A plurality of electric heating tubes 13 are mounted between the supporting plates 16. A plurality of far infrared emitting sleeves 14 are respectively sleeved onto the electric heating tubes 13. The far infrared emitting sleeves 14 emit far infrared rays when heated. A reflector 18 is mounted inside the housing 1, and adapted to reflect far infrared rays from the far infrared emitting sleeves 14, permitting reflected far infrared rays to pass out of the housing 1 through gaps in the grille 12. Two elongated ventilation members 17 are bilaterally connected between the supporting plates 16 at two opposite sides of the reflector 18, having each a row of air vents 171. Further, a light 111 is mounted on the left cover shell 11 on the outside. The hood 22 is fixedly fastened to the slotted top cover shell 19 of the housing 1 by screws 121, having an exhaust hole 23. A packing plate 2 is mounted between the top cover shell 19 and the hood 22.

Figure 4:
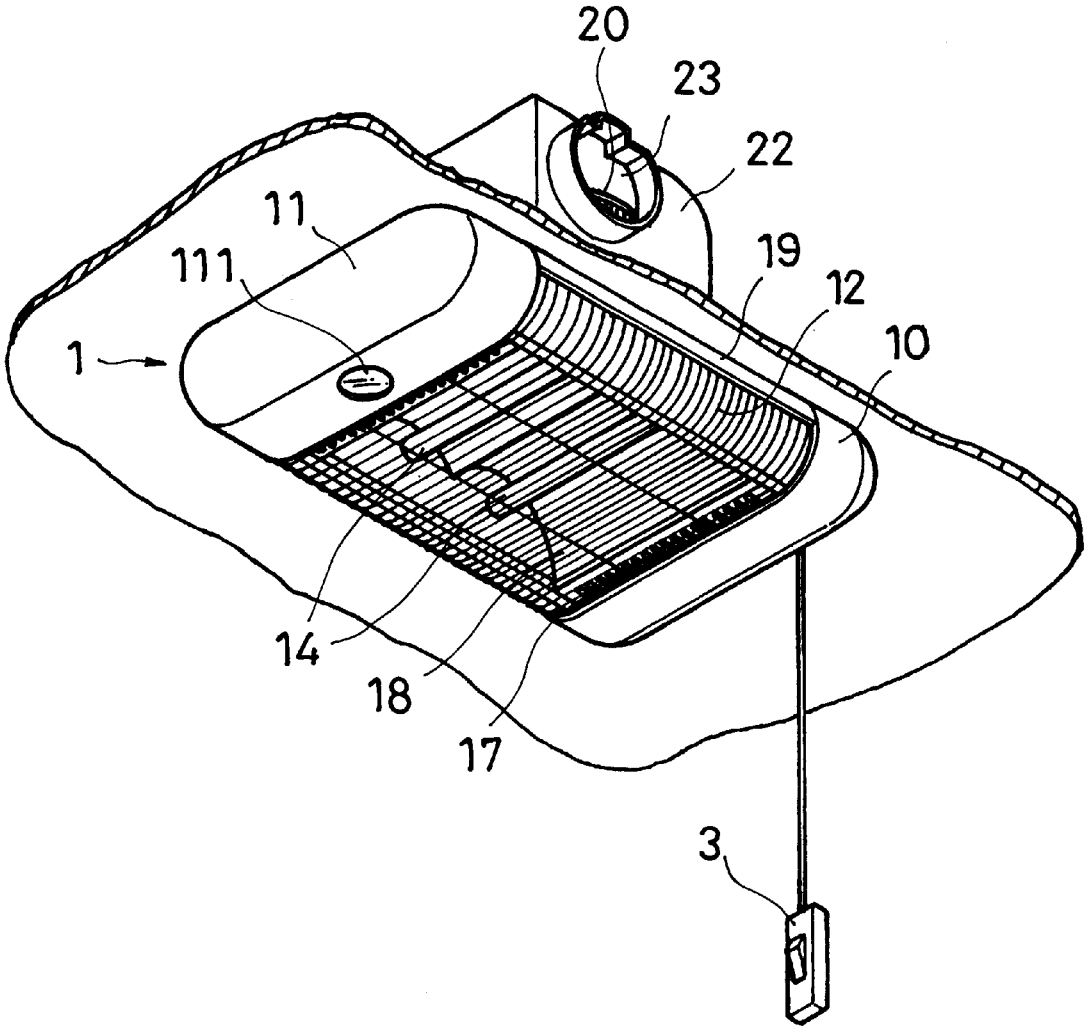

Referring to FIG. 4 and FIG. 2 again, the housing 1 is shown mounted to a planar surface 50 of a building, i.e. a wall, and a switch 3 is provided for controlling the operation of the ventilation device. When the switch 3 is switched on, the fan 20 is driven by the fan motor 21 to draw filthy air from the room into the housing 1 through the air vents 171 on the ventilation members 17, permitting filthy air to be driven out of the room through the exhaust hole 23, at the same time the electric heating tubes 13 are turned on to produce heat, and the far infrared emitting sleeves 14 are heated to emit far infrared rays, permitting far infrared rays to be reflected by the reflector 18 toward the inside of the room. Further, the light 111 can be separately turned on by a separate switch (not shown).

While only one embodiment of the present invention has been shown and described, it will be understood that various modifications and changes could be made thereunto within departing from the spirit and scope of the invention disclosed.

What the invention claimed is:

1. A ventilation device comprising:

a housing, said housing including a right cover shell, a left cover shell, a grille connected between said right cover shell and said left cover shell at a bottom side, a slotted top cover shell connected between said right cover shell and said left cover shell at a top side, two supporting plates connected between said right cover shell at two opposing sides of said grille, and two arched guard plates respectively connected to said two supporting plates adjacent said right cover shell and said left cover shell, said two arched guard plates covering said supporting plates;

a plurality of electric heating tubes mounted inside said housing between said supporting plates;

a plurality of sleeves respectively sleeved onto said electric heating tubes, each of said sleeves being formed of a far infrared material for emission of energy in a far infrared portion of the electromagnetic spectrum when said sleeve is heated;

a reflector mounted inside said housing, and adapted to reflect said far infrared emissions of said sleeves, permitting reflected far infrared energy to be projected out of said housing through gaps in said grille;

two elongated ventilation members bilaterally connected between said supporting plates at two opposite sides of said reflector, each of said ventilation members having a row of air vents formed therein;

a light source disposed in at least one of said left cover shell and said right cover shell;

a hood fixedly covered on said slotted top cover shell of said housing, said hood having an exhaust hole; and, fan means for drawing air into said housing through the air vents on said ventilation member, passing the air through said slotted top cover shell, and driving the air out of said hood through said exhaust hole.

* * * * *